US008534486B2

(12) United States Patent
Edmunds

(10) Patent No.: US 8,534,486 B2
(45) Date of Patent: Sep. 17, 2013

(54) CONTAINER COVER AND DISPENSER THEREFOR

(76) Inventor: Melissa Edmunds, Vale of Glamorgan (GB)

( * ) Notice: Subject to any disclaimer, the term of this patent is extended or adjusted under 35 U.S.C. 154(b) by 0 days.

(21) Appl. No.: 13/033,799

(22) Filed: Feb. 24, 2011

(65) Prior Publication Data

US 2011/0220650 A1 Sep. 15, 2011

Related U.S. Application Data

(63) Continuation of application No. 11/574,726, filed as application No. PCT/GB2005/003478 on Sep. 8, 2005, now Pat. No. 7,908,823.

(30) Foreign Application Priority Data

Sep. 8, 2004 (GB) ..... 0419895

(51) Int. Cl.
*B65D 41/22* (2006.01)

(52) U.S. Cl.
USPC ..... 220/287; 150/154; 220/709

(58) Field of Classification Search
CPC ..... B65D 2543/0037; B65D 2231/022; B65D 51/1644; B65D 43/0222; B65D 41/22
USPC ..... 220/287, 705, 220, 709, 712, 720, 220/721; 53/288, 287, 485, 488; 150/154
IPC ..... B65D 41/22
See application file for complete search history.

(56) References Cited

U.S. PATENT DOCUMENTS

| | | | | |
|---|---|---|---|---|
| 2,064,411 A | | 12/1936 | Brandstein | |
| 2,080,108 A | | 5/1937 | Brandstein | |
| 2,307,043 A | * | 1/1943 | Hothersall | 220/721 |
| 2,608,841 A | * | 9/1952 | Rice | 220/715 |
| 2,760,672 A | | 8/1956 | Cronheim | |

(Continued)

FOREIGN PATENT DOCUMENTS

| | | |
|---|---|---|
| DE | 29706653 | 7/1997 |
| DE | 10158044 | 6/2003 |

(Continued)

OTHER PUBLICATIONS

USPTO Office Action for U.S. Appl. No. 11/574,726 dated Jul. 1, 2010.

(Continued)

*Primary Examiner* — Stephen F Gerrity
(74) *Attorney, Agent, or Firm* — Tumey L.L.P.

(57) ABSTRACT

A container cover prevents spillage of contents. In one embodiment, the container cover includes a flexible body having a first portion that can be stretched over a mouth of a container. The container cover also includes a second portion providing a periphery around the first portion that can contract against the sides of a container on which the container cover is placed to hold the cover in position. The first portion when stretched over the mouth of the container has an extension forming an area of slack for the container cover to allow the container cover to expand as a result of increased pressure within the container. The container cover further includes the first portion also including an aperture to receive a tube for withdrawing contents from the container. The first portion of the container cover includes a venting system. The venting system is provided by a valve.

25 Claims, 7 Drawing Sheets

(56) References Cited

U.S. PATENT DOCUMENTS

| | | | | |
|---|---|---|---|---|
| 2,821,230 | A | 1/1958 | May | |
| 3,141,567 | A | 7/1964 | Schearer | |
| 3,172,561 | A | 3/1965 | Schwartz | |
| 3,189,208 | A | 6/1965 | Edward | |
| 3,507,416 | A | 4/1970 | Rohe et al. | |
| 3,862,614 | A | 1/1975 | Kovac | |
| 4,043,368 | A | 8/1977 | Forte | |
| 4,119,128 | A | 10/1978 | Bishop | |
| 4,311,492 | A | 1/1982 | Eltvedt | |
| 4,331,255 | A * | 5/1982 | Fournier | 220/257.2 |
| 4,428,498 | A | 1/1984 | Obey | |
| 4,429,803 | A | 2/1984 | Butterfield | |
| 4,586,625 | A | 5/1986 | Garrett | |
| 4,948,009 | A | 8/1990 | Sawatani | |
| 5,016,774 | A | 5/1991 | Rodriguez | |
| 5,339,981 | A | 8/1994 | Kral | |
| 5,361,935 | A | 11/1994 | Sagucio | |
| 5,702,025 | A | 12/1997 | Di Gregorio et al. | |
| 5,709,312 | A | 1/1998 | Lake | |
| 6,230,923 | B1 | 5/2001 | Hung | |
| 6,260,729 | B1 | 7/2001 | Mitchell et al. | |
| 6,276,551 | B1 | 8/2001 | Miller, II | |
| 6,457,597 | B2 | 10/2002 | Hirota et al. | |
| 6,793,090 | B2 | 9/2004 | Ackerman et al. | |
| 7,011,228 | B2 | 3/2006 | Ordiway | |
| 7,051,895 | B2 | 5/2006 | Toussant et al. | |
| 7,318,534 | B2 | 1/2008 | Turvey et al. | |
| 2002/0145000 | A1 | 10/2002 | Li | |
| 2004/0099666 | A1 * | 5/2004 | Ordiway | 220/287 |
| 2004/0140314 | A1 * | 7/2004 | Li | 220/709 |
| 2004/0191369 | A1 * | 9/2004 | Veillon | 426/106 |
| 2005/0029270 | A1 | 2/2005 | Marshall | |

FOREIGN PATENT DOCUMENTS

| | | |
|---|---|---|
| GB | 370027 | 11/1930 |
| GB | 2238303 | 5/1991 |
| GB | 2327933 | 2/1999 |
| GB | 2382069 | 5/2003 |
| JP | 2004049856 | 7/2002 |

OTHER PUBLICATIONS

USPTO Office Action for U.S. Appl. No. 11/574,726 dated Jan. 12, 2010.

USPTO Office Action for U.S. Appl. No. 11/574,726 dated Aug. 14, 2009.

USPTO Office Action for U.S. Appl. No. 11/574,726 dated May 1, 2009.

International Search Report for International Application No. PCT/GB2005/003478 dated Nov. 22, 2005.

UK Search Report for GB0518399.1 dated Nov. 3, 2005.

* cited by examiner

CONTAINER COVER AND DISPENSER THEREFOR

CROSS-REFERENCE TO RELATED APPLICATIONS

This application is a continuation of U.S. patent application Ser. No. 11/574,726, entitled "Container Cover and Dispenser Therefor," filed on Sep. 21, 2007, now U.S. Pat. No. 7,908,823, the entire disclosure of which is incorporated herein by reference.

STATEMENT REGARDING FEDERALLY SPONSORED RESEARCH OR DEVELOPMENT

Not applicable.

BACKGROUND OF THE INVENTION

1. Field of the Invention

This invention relates to a container cover and in particular but not exclusively to a container cover used to prevent spillage of contents from the container and/or to prevent tampering with the container contents. The invention also encompasses a dispenser for container covers as described.

2. Background of the Invention

Spillage of drinks from containers is not uncommon. Young children that are not used to holding a cup at the correct angle for drinking can often spill drinks. Further hospitalized patients that may have to take in liquids when lying in bed may also find it difficult to use a conventional cup without the risk of spilling the cup contents. Also if a drink is prepared some time prior to it being served, there is also the risk that the drink may become contaminated. This may be through airborne bacteria, environmental pollution such as dust, or even insects such as wasps. In addition a particular problem that has recently become prevalent is the spiking or contamination of drinks by third parties, which can be particularly dangerous for drinkers in bars and nightclubs. Therefore it is desirable to have a container cover which can reduce or eliminate spillage and/or contamination.

Covers for drinks containers are known, for example GB 2382069 discloses a protective cap for a bottle, formed of a mesh with there being a hole through which a drinking straw can be inserted. However, the use of a mesh which is not watertight would result in some spillage if the bottle was tipped over. Also, the cover is designed to be fitted over the rim of a bottle of a particular shape and so is of fixed dimensions which does not allow for flexibility of use.

GB 395110 discloses the use of a slip over lid formed of a disc and elasticated ring which may be put over the top of a cup. However, the ring is of a predetermined size and will not fit over containers of different sizes and so its use is limited. Also, there is no provision for insertion of a drinking straw as the cup is to be used when sitting in the upright position. GB 2238303 shows a latex lid to seal a beverage cup with a thinner area for insertion of a straw. The lid can be expanded to fit containers of varying sizes. However, there is no provision for venting of the cup. If a child blows into the cup, or if there is a build up of gas in the cup because it contains a fizzy drink, there is the risk of the lid ballooning and becoming dislodged.

BRIEF SUMMARY OF SOME OF THE PREFERRED EMBODIMENTS

The current invention seeks to overcome previous problems associated with the prior art by providing a cover that can be adapted to be used on a wide range of container shapes and sizes, and which allows for the insertion of a device such as a tube or straw to withdraw fluids from the container so the cup can be used at varying angles, as well as providing a venting system for release of gases that may have built up within the container.

According to a first aspect of the invention, there is provided a container cover comprising a flexible body having a first portion that can be stretched over a mouth of a container and a second portion providing a periphery around said first portion that can contract against the sides of a container on which the container cover is placed to hold the cover in position, wherein the first portion when stretched over the mouth of the container has an extension forming an area of slack for the container cover to allow said container cover to expand as a result of increased pressure within the container, with the first portion also including an aperture for receiving a tube for withdrawing contents from said container.

Preferably, the first portion forms an inner portion which comprises a substantially circular area that forms a covering over the mouth of the container with the second portion being provided as a ring forming an outer portion extending around the periphery of the substantially circular area forming the inner portion. However, the inner portion can be of other shapes, for example a square or rectangle, with the out portion being of dimensions to form a periphery around the inner portion.

Preferably the area of slack for the container cover is provided by material of greater flexibility than material forming the rest of the container cover. The area of slack can be said to form a "teat". The teat forms an area of slack in the container cover that allows the straw to be moved within the container and also reduces the overall tension across the inner portion when it is stretched over the mouth of the container. The teat is of an elongate form such that when the cover is not in use i.e. no tube in inserted in the cover and the container cover is not under pressure, the teat hangs within the body of the container. The aperture of the teat includes sealing edges to attach the area provided by the aperture to a straw that is inserted through the cover. Alternatively, the teat may be formed of thicker material allowing it to stand proud of the container cover. Advertising material such as slogans may be printed on the teat.

Preferably an area of the container cover which is in proximity to the teat includes an aperture through which the tube or straw can be inserted.

The first portion is made of a thus flexible material of substantially between 0.018 mm and 0.025 mm preferably 0.012 mm to 0.035 mm in thickness.

It is envisaged that the teat or the first portion (also referred to as the inner portion) can include a number of additional apertures which can allow for venting of the container by way of a venting system.

In a preferred arrangement, the venting system is provided by a valve.

It is preferred that the valve is a one way valve to release gasses from the container and to prevent airborne contaminants from entering the container. It is preferred that the apertures in the inner portion are bounded by areas of thickened material which form the venting system for the container.

Preferably said venting system comprises a series of concentric boundaries having apertures between said boundaries.

In an alternative arrangement, it is envisaged that the venting system may comprise a concentric boundary defining an area within which there is a lattice of thickened areas, with there being apertures in one or more of the areas bordered by the thickened areas forming the lattice.

Preferably, the venting system includes the area of weakness for receiving the tube or straw.

It is envisaged that the area of weakness is bounded by concentric rings of thickened material wherein there are venting apertures between said concentric rings.

It is preferred that the venting system comprises a dome structure which can support the straw when placed through the area of weakness.

It is envisaged that the aperture for receiving the tube and/or the additional apertures of the venting system are provided by a series of lobes. The lobes form flaps, which can move away from each other to reveal a hole into which a tube can be inserted. This arrangement provides a flap valve, similar to a valve found in the heart.

It is preferred that the lobes each have include an adhesive such that the lobes can attach to a tube inserted between them or to one another to seal the container cover when not in use. The lobes may be formed of a self healing material to allow for closure of the aperture.

In a preferred arrangement, the container cover includes a series of longitudinal ribs extending in a direction from the area of slack to the periphery of the container cover, thereby forming a ribbed structure.

It is envisaged that the flexible body is formed of a latex material. Preferably, the latex is a natural latex to allow for biodegradability of the cover when it has been discarded after use. However, the flexible body may be made from other materials such as polyurethane. In any event, it is important that the material used allows the body to be stretched over a container relatively easily, without ripping or tearing.

Preferably, the outer portion of the cover that grips the sides of a container includes thickened areas of material. These areas may have a raised surface, so increasing the ease of grip of the container and reducing the risk of the container slipping from the hand.

It is envisaged that the outer portions can include one or more tab areas extending from said outer portion which may be gripped thereby assisting pulling of the flexible body over the mouth and down the sides of the container.

Although the container cover has been described as an anti-spill device, it also has applications to prevent spiking of drinks, which has become an increasingly common problem.

By having a cover which stretches over as being flexible seals itself to a container such as a drinks container, it would become impossible or at least very difficult for third parties to introduce other materials into a drink.

Further, the container cover may be used to reduce the risk of contamination of food in general, for example jams or preserves.

Preferably, the cover may be formed of a layered material, having at least one layer including a dye that can be released should the cover be broken so providing a visual indication that the cover has been tampered with.

It is also envisaged that the cover is made from a transparent material that allows the contents of the container to be viewed. However, coloured covers may be used or even covers having areas that fluoresce, which provide a means of identifying a container, for example in a nightclub.

According to a further aspect of the invention, there is provided a dispenser for container covers as previously described, said device comprising a receptacle for a stack of container covers, with one or more supports for said covers, an aperture at the base of said receptacle for receiving a container to which a cover is to be attached, means to bring a bottom cover from said stack into proximity with the mouth of the container and a stop, positioned under said stack so that said container and cover can be pushed upwards until meeting said stop thereby enabling the cover to be stretched over the mouth and down at least a portion of the sides of said container. The container covers are those as mentioned in the first or the second aspects of the invention or even a cover that combines both aspects of the invention.

It is envisaged that the covers are separated from one another by ridges on the inner surface of the receptacle.

It is preferred that a lever or handle is operable to release a cover at the base of the stack of covers so that it can move down into proximity with the mouth of the container.

It is envisaged that the stop which is towards the upper portion of the area where a container can be inserted, is adjustable so that the distance that a container can be inserted may be varied according to the height of the container.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

An example of the invention will now be described with reference to the accompanying Figures which are shown by way of example only.

DETAILED DESCRIPTION OF THE PREFERRED EMBODIMENTS

Figure 1A:
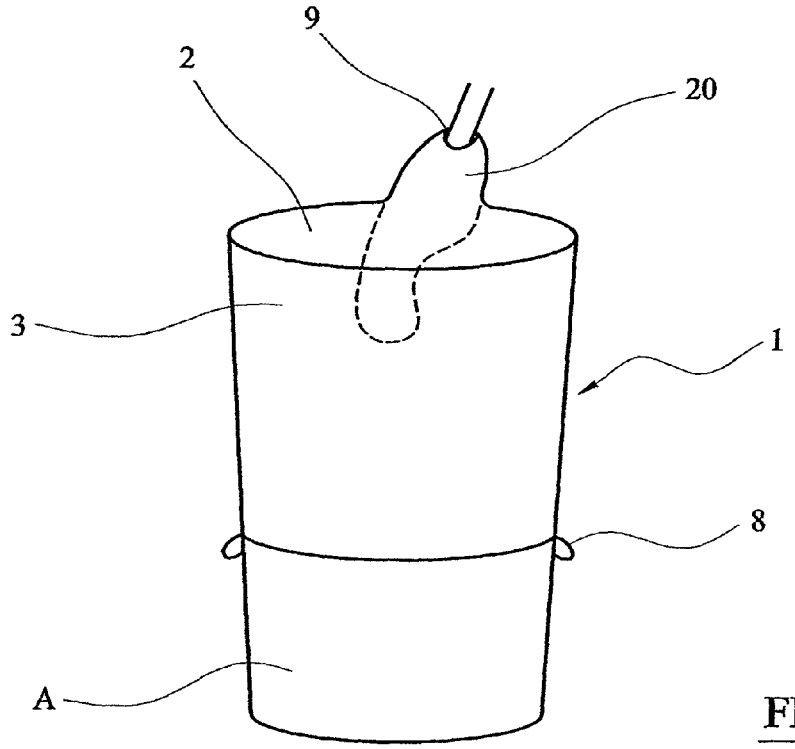
FIG. 1A: Shows a side view of a container cover according to a first aspect of the invention, when placed over a cup.

FIG. 1A shows a container cover that is generally shown as 1. The cover comprises an inner portion 2 which stretches over and covers the mouth of a cup A. The inner portion includes a pierceable area which can provide an aperture 9.

The figure shows a container receiving a straw B. The inner portion includes a "teat" of material that is not drawn as tightly over the mouth of the container as the inner portion 2. This allows for a degree of slack in the cover. The inner portion 2 is bounded by an outer portion 3 which can be pulled down the sides of the cup A, so securing the container cover 1 in place. To assist in pulling the outer portion 3 down the sides of the cup there are grip areas 8. Preferably the container cover is a clear flexible member. The outer portion which extends down the sides of the container also provide an added safety feature in that as the outer portions 3 are drawn against the sides of the container due to the inherent flexibility of the material used, if the container is made of breakable material and is dropped the portions 3 prevent the release of shattered material. This is because the sides constrain the material such as glass within the confines of the portion 3.

Figure 1B:
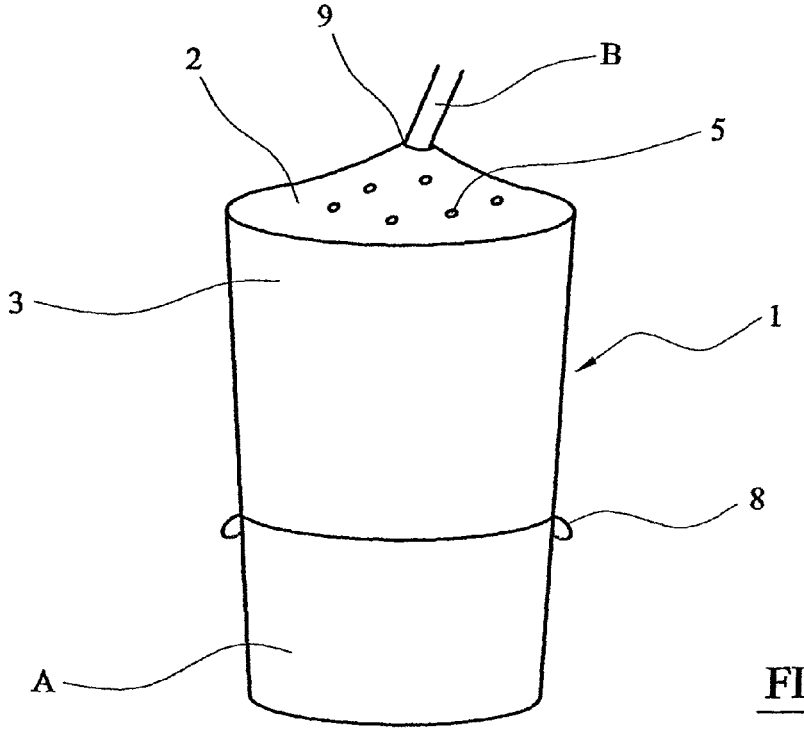
FIG. 1B: Shows a side view of a container cover according to a second aspect of the invention, when placed over a cup.

A container cover is generally shown as 1 in FIG. 1B. The cover comprises an inner portion 2 which stretches over and covers the mouth of a cup A. The inner portion includes a pierceable area to provide an aperture 9 for receiving a straw B. Also included in the inner portion are apertures 5 which allow for venting of the cup. The container cover may includes a teat as shown in FIG. 1A which provides "slack" in the container cover.

Figure 2:
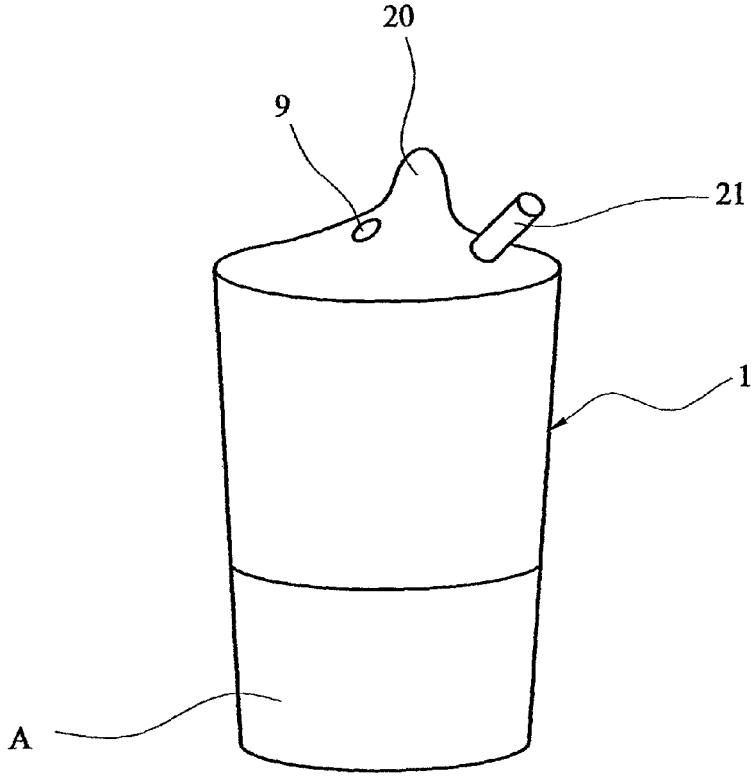
FIG. 2: Shows a side view of a further embodiment of the invention including a valve and an aperture for-receiving a tube or straw.

FIG. 2 shows a container cover having an extended area to form an area of slack 20 with aperture 9 being in proximity thereto. The first portion of the container cover also includes a valve 21 to provide venting of the container cover when in position on a container.

Figure 3:
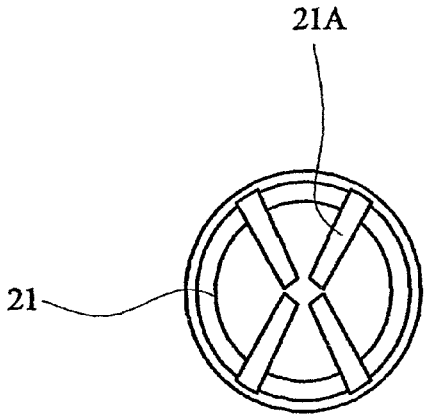
FIG. 3: Shows a plan view of a valve as shown in FIG. 2.

FIG. 3 shows a plan view of a circular one way-valve 21, which has a series of inwardly projecting ribs 21A.

Figure 4:
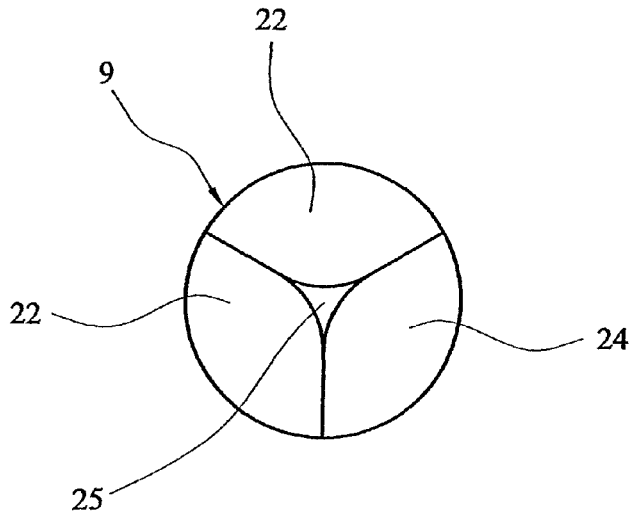
FIG. 4: Shows a plan view of an aperture.

FIG. 4 shows an aperture 9 which may be formed in the container cover according to the present invention. The aperture is provided by a series of lobes, here shown as three lobes 22, 23, 24, which meet at a central area 25. The lobes may include an adhesive, or be formed of a self-healing material such that when they meet one another, they close the aperture region 25 where the lobes meet. Although three lobes are shown as forming the flap valve less or more lobes can be used.

Figure 5:
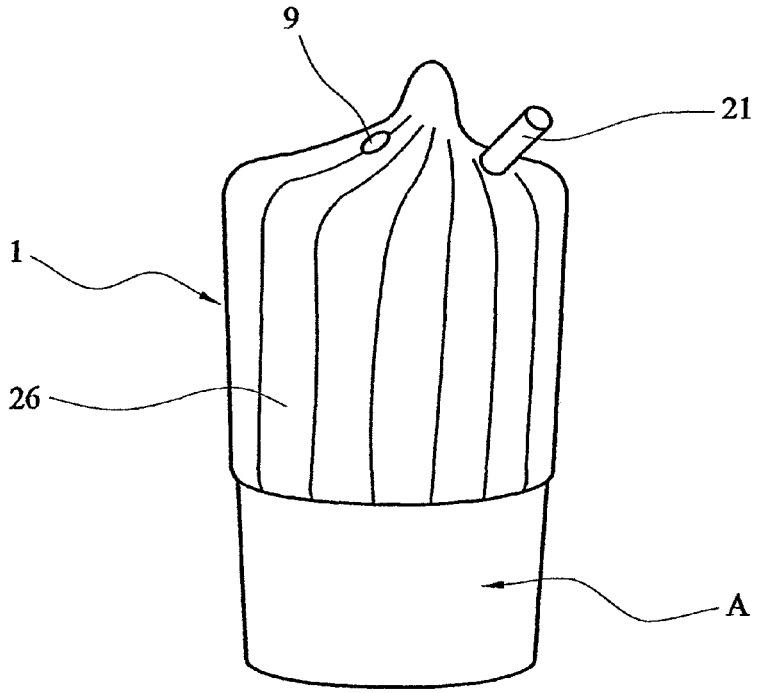
FIG. 5: Shows ribbing on a container cover according to an embodiment of the invention.

FIG. 5 shows the container cover provided with a series of ribs 26, which assist in gripping of a container on which the container cover is placed and which also provide a pleasing aesthetic appearance for the cover and container.

Figure 6:
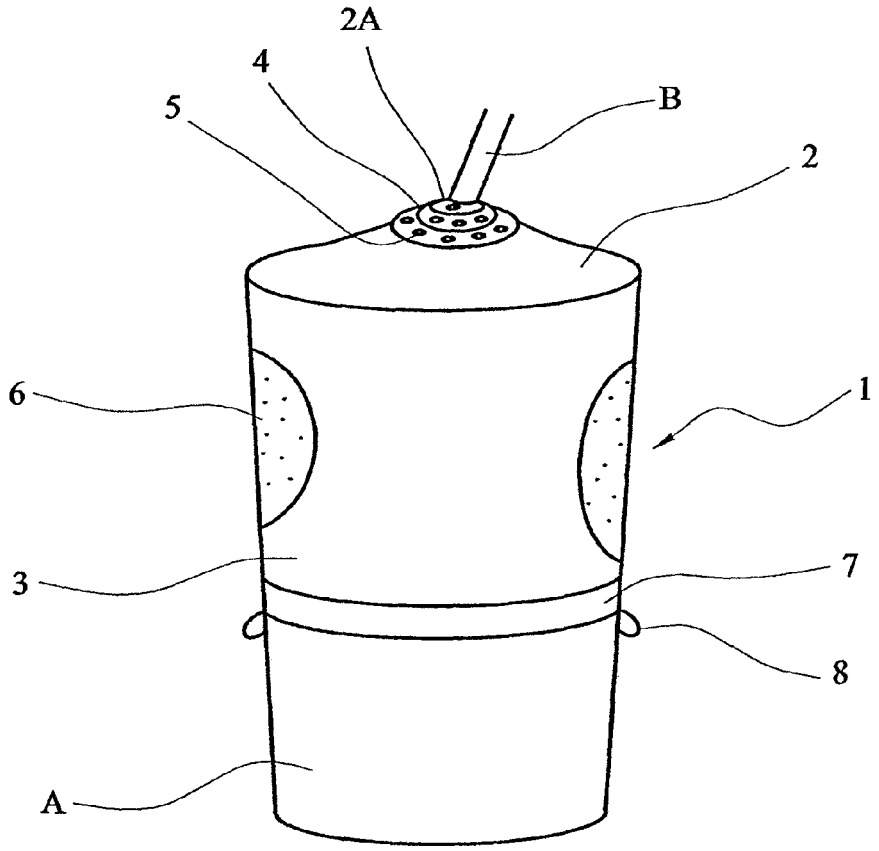
FIG. 6: Shows a side view of a container cover according to a further embodiment of the invention.

FIG. 6 shows a further embodiment of the invention, where the area of the cover having a main aperture 9 and vent apertures 5 which are bounded by areas of thickened material 4. As shown in FIG. 1, the raised dome or teat area which is the area which supports a straw B in a substantially upright orientation, or at a selected angle. The raised dome includes concentric rings 4 of thickened or ribbed material and these form a series of rings around the straw. The rings form raised ribs between which there are areas of thinner material. The thinner material includes apertures 5, which may be preformed or which may be punched through the material between the rings to provide vent holes.

The cover also includes portions 3 which extend down and grip the sides of the container. The side portions include grip regions 6, which are positioned such that they are toward the upper portion of the container A. The grip regions may include areas of profiling such as raised nodules which provide a secure grip for a person holding the container.

Towards the edge of the cover is a thickened band 7, which extends around the base of the cover and consequently around the periphery of the cup A. This band allows for the cover to be pulled down the container and being thickened, minimizes ripping of the cover, which preferably is a natural latex material. The band may also include tabs 8, which can be pulled to ensure that the cover is fitted to approximately half to three quarters of the way down the cup A. This provides an optimum gripping area to secure the cover on the cup.

The cover includes a venting system. As the cover is flexible, if a child was to blow through the straw, the cover would expand and if there was no venting, it could be blown off the cup. Further, if the drink in the cup includes or releases steam or a gas, again, if there is no venting system, there is the risk of the cover coming off the cup which could mean that the contents can be spilled.

Figure 7:
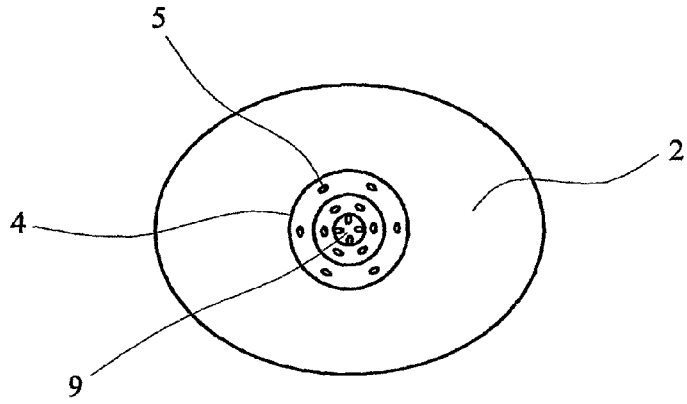
FIG. 7: Shows a plan view from above of a container cover as shown in FIG. 6, with a venting system according to a further embodiment of the invention.

An embodiment of a venting system is shown in FIG. 2 using a valve but the venting system may comprise apertures as shown in FIG. 7. Around the aperture 9, there are concentric rings 4 which are formed as a rib which encircles the tube or straw. Between the ribbed rings, there are thinner areas of material having a series of apertures. The apertures 5 are preferably formed as a ring of apertures in each area between the ribs. The apertures allow for venting of gas from the cup so assisting in the cover being kept in contact with the container. The cover 1 is made from a relatively thin latex material which ideally is between 0.018 mm and 0.025 mm in thickness, thereby providing a flexible structure. The apertures form areas of weakness which makes the cover prone to tearing and therefore if there is any tearing, by having the ribbing bounding the area(s) where the apertures are, this minimizes the risk of the whole cover being torn and hence rendered unusable. Consequently, not only does this increase the safety features of the cover, but it also minimizes cost of production as there is a self limiting risk of damage due to the way the ribbing and apertures are positioned relative to one another.

The aperture 9 for receiving a straw may be provided as a preformed hole in the cover. Alternatively, there may be perforations which would be broken when a straw is pushed through the aperture. Again by having ribbing bounding this area, the risk of tearing the whole cover is reduced. Once the straw B is pushed through the aperture 9 the edges of the flexible cover cling to the straw, so forming a seal around the straw. By having a dome structure, this provides an area of support for the straw.

Figure 8:
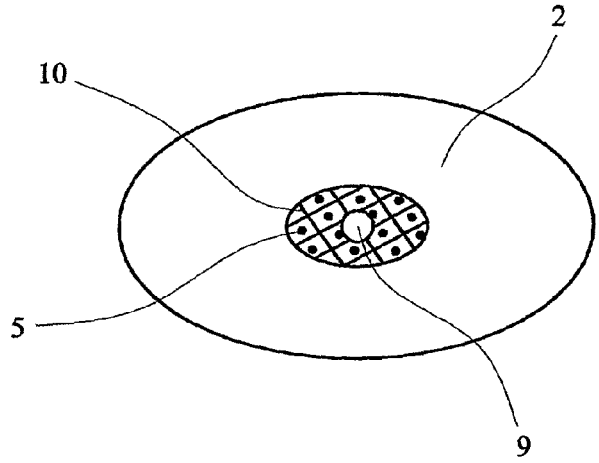
FIG. 8: Shows a plan view from above of a container cover with a venting system having a lattice arrangement.

FIG. 8 shows an alternative rib and aperture arrangement. The cover 1 has inner portion 2 with an aperture for a straw. There is a lattice structure 10 formed of thickened areas of material which also forms the cover. In the diamond shapes formed by the lattice, there are apertures 5, which provide the means whereby gas from a container on which the cover is placed can be vented. The lattice may be formed as an integral process in the manufacture of the cover or it may be applied and sealed to the cover as a post main manufacturing process.

Figure 9:
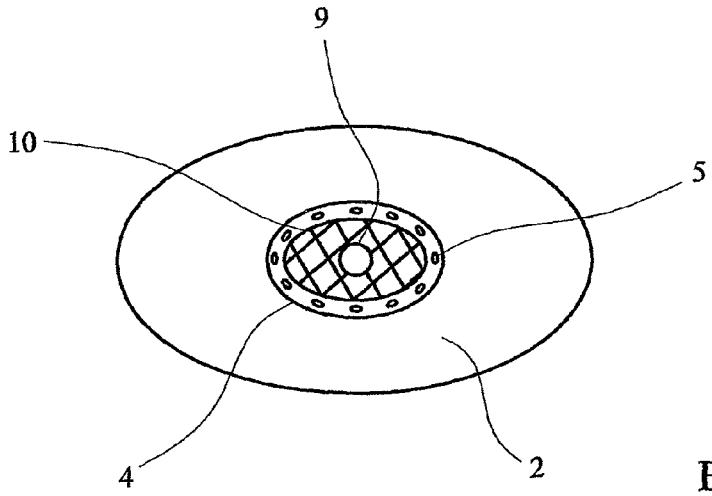
FIG. 9: Shows a plan view from above of a container cover with a venting system which is a combination of the systems shown in FIGS. 3 and 4.

FIG. 9 shows what may be viewed as a combined arrangement of those shown in FIGS. 7 and 8. Inner portion 2 of the cover includes an area of weakness 9. The area 9, has an area of raised ribs 10, forming a lattice area around area 9. The lattice may include apertures 4 but in this case, there are no apertures as the lattice is there to provide an area of reinforcement and strengthening for the cover 1. There are then two concentric rings 4 forming a boundary around the lattice area. Between the rings 4, there are perforated apertures 5, to provide for venting of the container.

Figure 10:
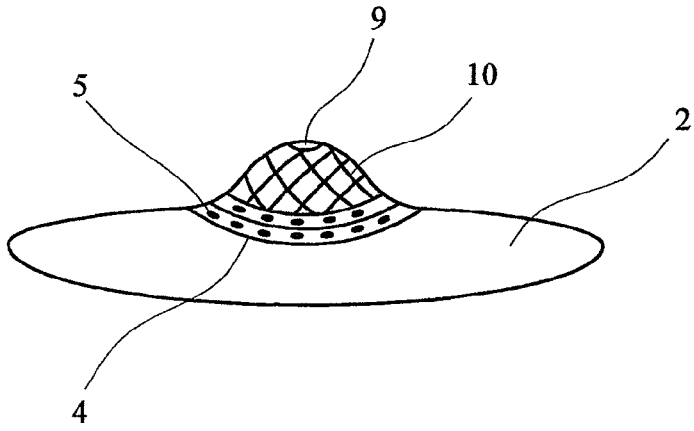
FIG. 10: Shows a side view of a container cover with the venting system being in the form of a raised dome.

A side view of a similar arrangement to that of FIG. 10 is shown in FIG. 9. The lattice 10 is provided as a domed region extending from the inner portion 2 of the cover. The dome provides support for a straw that is pushed through the area of weakness 9. Again, concentric rings bound the lattice area and include venting apertures 5. Although the rings 4 that have been shown are substantially circular, it is envisaged that they may be of other shapes, for example, oval, square or irregular shaped. However, what is important is that the ribbed strengthened areas form a boundary around any area where there are venting apertures 4 in the cover.

Figure 11:
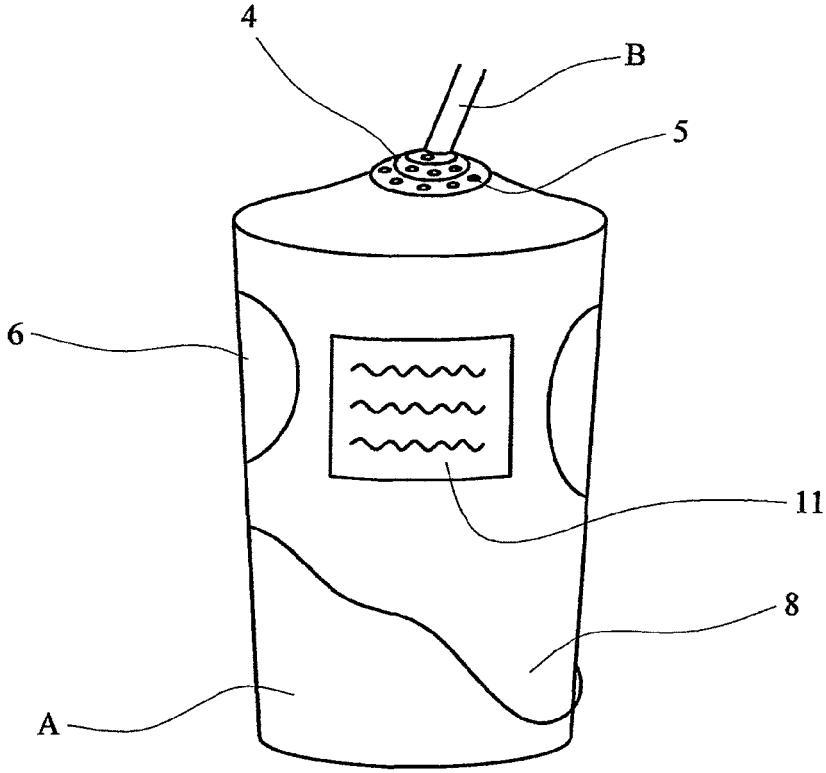
FIG. 11: Shows a further embodiment of the invention with the sides of the container cover including a tab region for pulling the cover into position.

FIG. 11 shows a similar arrangement to that of FIG. 2. However, in this embodiment, rather than having a skirt region 7, forming a circumferential skirt around the cover, there is a depending skirt forming a skirt and an integral pull tab 8 which allows the cover to be pulled down the sides of cup A. Also shown are grip regions 6 for holding the cup once the cover is in position. There is an area 11, where advertising material can be printed on the cover, for example a brand name of a drink or the name of the bar where the drinks are being served. It is also envisaged that characters for example film or cartoon characters can be printed on the cover or even customised slogans for the drinker using the cup. Although grip regions 6 are shown in FIG. 6, these grip regions do not have to be present and there can be printing all over the surface of the container and especially down the sides 3 so providing means to advertise for example drink products or outlets supplying the drinks.

Figure 12:
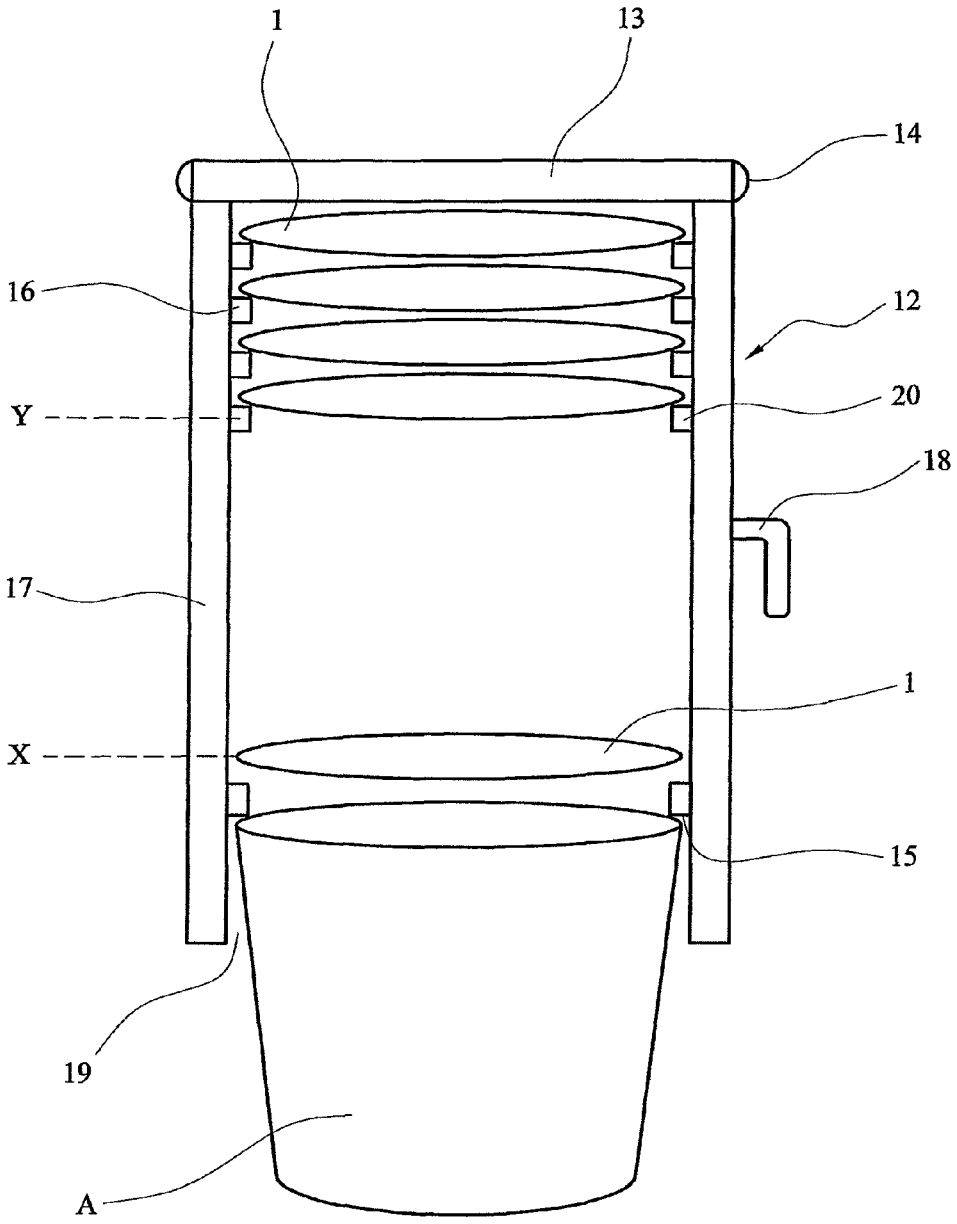
FIG. 12: Shows a dispenser for container covers as shown in embodiments of the invention.

FIG. 12 shows a dispenser for flexible container covers and in particular, for covers as described for the first and second embodiment of the invention.

The dispenser generally shown as 12 comprises a main body 17 having a lid 13 and an aperture 19 at its base. The lid 13 may be hinged by attachment hinges 14 to the body 17, so allowing the dispenser to be filled with covers 1.

The covers 1 are separated by ridges 16, which hold each cover in readiness for attaching to a container A.

A container A can be inserted into the aperture 19 at the base of the dispenser. Handle 18 is operated to bring a cover 1, which is supported by ridge 15 into proximity with the container A. The container A is then pushed upwards through the body of the dispenser until it reaches a stop 20 which is below the stack of covers. As the cup is pushed upwards from point X to point Y the cover 1 is stretched over the mouth of the cup and down its sides and it snaps onto the cup A.

Although the present invention and its advantages have been described in detail, it should be understood that various changes, substitutions and alterations may be made herein without departing from the spirit and scope of the invention as defined by the appended claims.

What is claimed is:

1. A container cover comprising a flexible body having a first portion that can be stretched over a mouth of a container and a second portion providing a periphery around said first portion that can contract against sides of a container on which the container cover is placed to hold the cover in position, wherein the first portion when stretched over a mouth of a container includes an area which is drawn taut over a container and an area of slack for allowing expansion as a result of increased pressure within a container, with the first portion also including an aperture to receive a tube for withdrawing contents from a container, wherein the first portion of the container cover includes a venting system, and wherein the venting system is provided by a valve.

2. A container cover according to claim 1, wherein the first portion comprises a substantially circular area that forms a covering over a mouth of the container with the second portion being provided as a ring forming an outer portion extending around the periphery of the substantially circular area forming the inner portion.

3. A container cover according to claim 1, wherein the area of slack for the container cover is provided by material of greater flexibility than material forming the rest of the first portion of the container cover, thereby forming a teat in the container cover.

4. A container cover according to claim 3, wherein the teat is formed of thicker material allowing it to project outwardly from the container cover.

5. A container cover according to claim 3, wherein the teat includes the aperture in which a tube is inserted.

6. A container cover according to claim 1, wherein the first portion of the container cover is formed of material of between 0.018 mm and 0.025 mm in thickness.

7. A container cover according to claim 1, wherein the valve is a one way valve.

8. A container cover according to claim 1, wherein the venting system is provided by one or more vent apertures in addition to the aperture for receiving a tube.

9. A container cover according to claim 1, wherein the venting system comprises a series of concentric boundaries formed of a thickened material, with there being apertures between said boundaries.

10. A container cover according to claim 9, wherein the boundaries are provided as concentric rings.

11. A container cover according to claim 9, wherein the venting system comprises a concentric boundary defining an area within which there is a lattice of thickened areas, with there being vent apertures in one or more of the areas bordered by the thickened areas forming the lattice.

12. A container cover according to claim 1, wherein the venting system includes an area of weakness for receiving a tube or straw.

13. A container cover according to claim 12, wherein the venting system comprises a dome structure which can support a straw when placed through the area of weakness.

14. A container cover according to claim 1, wherein the aperture for receiving a tube is formed by a series of cuts forming lobes in the material forming the container cover.

15. A container cover according to claim 14, wherein the lobes each include an adhesive such that when the lobes come together, they seal the aperture.

16. A container cover according to claim 14, wherein the lobes are formed of a self-healing material to allow for closure of the aperture.

17. A container cover according to claim 1, wherein the aperture for receiving a tube is bounded by one or more areas of thickened material.

18. A container cover according to claim 1, wherein the flexible body is formed of a material selected from the group consisting of: latex material, natural latex, and polyurethane.

19. A container cover according to claim 18, wherein the material is biodegradable.

20. A container cover according to claim 1, wherein the second portion of the container cover that can contract against sides of a container includes thickened and/or raised areas of material.

21. A container cover according to claim 1, wherein the container cover includes a series of longitudinal ribs extending in a direction from the area of slack to the periphery of the container cover, thereby forming a ribbed structure.

22. A container cover according to claim 1, wherein the second portion includes tab areas extending from said second portion which may be gripped thereby assisting in pulling of the flexible body over a mouth and down sides of a container.

23. A container cover according to claim 1, provided as an anti-spill device or a device to prevent contamination of material within a container.

24. A container cover according to claim 1, wherein the container cover is formed of a layered material, having at least one layer including a dye that can be released should the cover be broken thereby providing a visual indication that the container cover has been tampered with.

25. A container cover according to claim 1, wherein the container cover is made from a transparent material that allows contents of a container to be viewed or the container cover is of a colored or fluorescent material to provide a means of identifying a container on which the cover is placed.

* * * * *